United States Patent [19]

Vassallo

[11] 4,073,029

[45] Feb. 14, 1978

[54] PARTS CLEANER

[76] Inventor: Alphonse C. Vassallo, 1439 Wayland, San Francisco, Calif. 94134

[21] Appl. No.: 690,407

[22] Filed: May 27, 1976

[51] Int. Cl.[2] ..... B08B 7/04

[52] U.S. Cl. ..... 15/302; 15/306 B

[58] Field of Search ..... 15/302, 306 A, 306 B, 15/306 R; 134/49, 56 R, 60, 82, 83, 113

[56] References Cited

U.S. PATENT DOCUMENTS

| | | | |
|---|---|---|---|
| 1,575,526 | 3/1926 | Böcher | 15/306 A X |
| 2,665,697 | 1/1954 | Hohl et al. | 134/83 X |
| 3,044,098 | 7/1962 | Stalson | 15/306 A X |
| 3,530,526 | 9/1970 | Schmidt | 15/302 |
| 3,592,689 | 7/1971 | Chaplinski | 15/302 X |
| 3,623,532 | 11/1971 | Cofer et al. | 134/60 X |
| 3,704,685 | 12/1972 | Neumann et al. | 134/82 X |

*Primary Examiner*—Christopher K. Moore
*Attorney, Agent, or Firm*—Robert G. Slick

[57] ABSTRACT

A parts cleaner is provided for taking small, oily parts from a machine tool, such as the output from an automatic screw machine, and successively subjecting the parts to a wiping action, a blast of solvent vapor, treatment with liquid solvent, and finally an air blast. The output from the parts cleaning device can be stored in a tube or passed onto another machine for a further operation. A novel sampling valve is provided for sampling the output of the machine tool after the parts have been cleaned as well as an automatic shut off device for the machine tool.

4 Claims, 5 Drawing Figures

PARTS CLEANER

SUMMARY OF THE INVENTION

In many machining processes, particularly an automatic screw machine, a large number of small, uniform parts are produced which are of necessity in a very oily condition as they leave the machine. In the past it has been necessary to gather up the parts and subject them to some form of cleaning operation. Ordinarily this is a batch operation and involves some manipulation of the parts, during which time the parts lose their orientation so that before a further manufacturing operation is commenced, it is necessary to re-orient the parts.

In accordance with the present invention, a fully automatic parts cleaning machine is provided which can be directly connected to the output of a manufacturing device, such as an automatic screw machine. The parts pass directly through the machine without attention and without losing orientation. After the parts are cleaned, they are discharged into a tube and the tube can be wound for storage so that the parts are available for subsequent manufacturing operation or the tube can lead directly to a second machine for a further operation.

In such manufacturing operations, it is frequently necessary to check the adjustment of the screw or other machine to make sure that the parts conform to a standard. Obviously, it is difficult to check such parts if they are covered with oil or grease, and the device of the present invention provides a convenient valve arrangement so that periodically one can remove one of the cleaned parts and check it for conformity with a standard.

The device of the present invention also provides an automatic shut off for the machine tool when the storage, or other subsequent device is full.

Various other features and advantages of the invention will be brought out in the balance of the specification.

DESCRIPTION OF THE PREFERRED EMBODIMENTS

Figure 1:
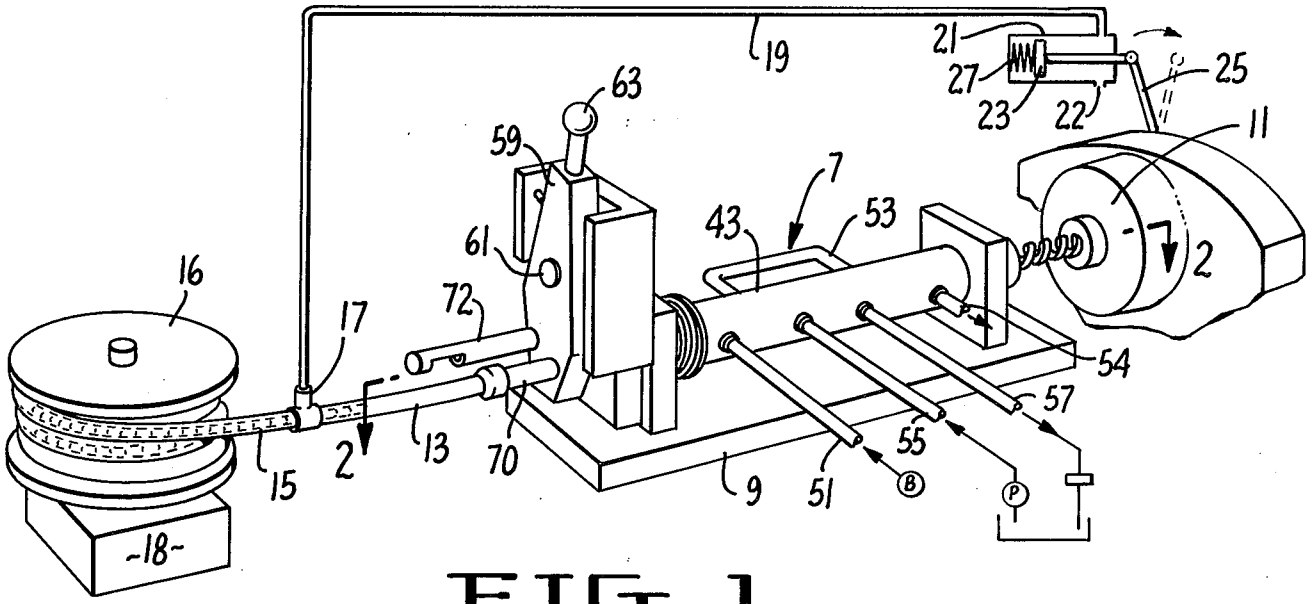
FIG. 1 is a perspective view of a parts cleaning machine embodying the present invention.
Figure 2:
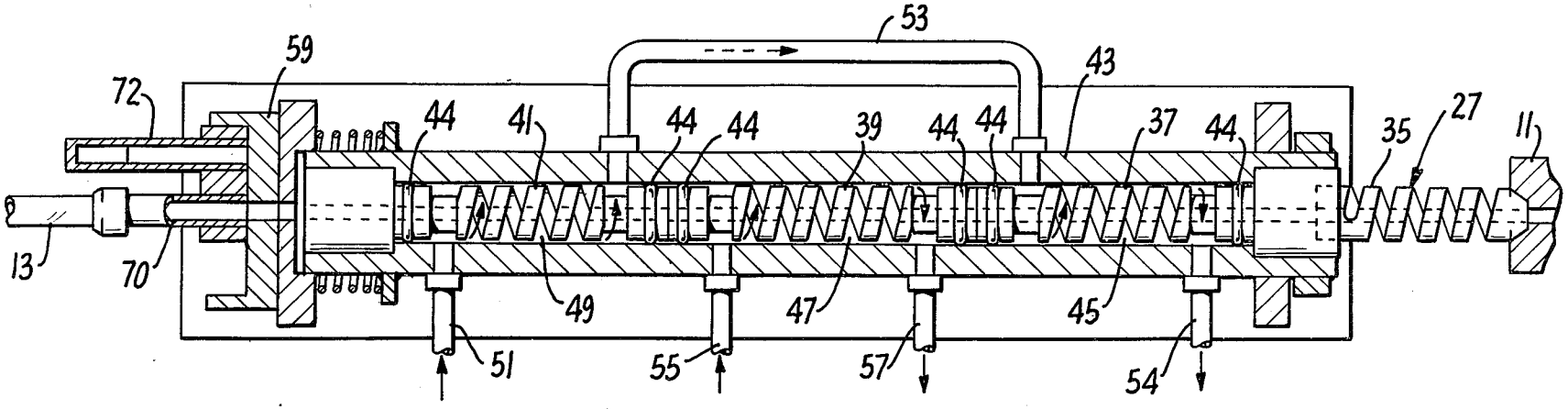
FIG. 2 is a section on the line 2—2 of FIG. 1.
Figure 3:
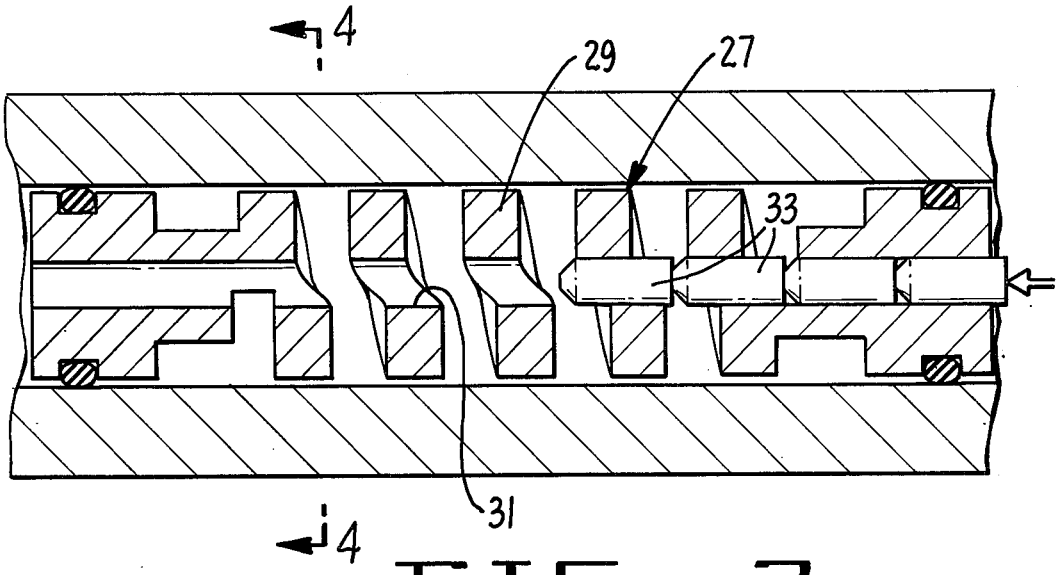
FIG. 3 is an enlarged section of a portion of the cleaning device.
Figure 4:
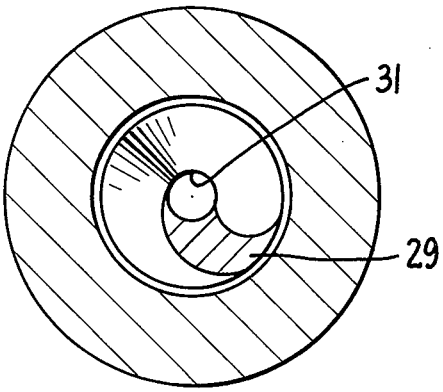
FIG. 4 is a section on the line 4—4 of FIG. 3.

Referring now to the drawings by reference characters, the cleaning device is generally designated 7 and is mounted on a base 9. The cleaning device is adapted to be attached to an automatic screw machine 11, although it will be understood, of course, that the device can be used with any source of small parts, and particularly by cylindrical parts. The output from the cleaning machine 7 is discharged through line 13 to which may be attached plastic tubing 15. Tubing 15 may be wound on a reel 16 mounted on a vibrator 18. In a practical embodiment of the machine, tubes up to 1000 feet long could be loaded. Of course, the output from the cleaner can go directly to another station for assembly or another operation.

A Tee 17 is provided connected to line 19 which leads to cylinder 21 which has a piston 23 connected by means of a usual piston rod to a shut off arm 25 on the screw machine 11. Cylinder 21 has a small bleeder hole 22. As will be later apparent, ordinarily there will be a leakage of air through the line 19 which will be sufficient to move the piston 23 to the left against the action of spring 27 and excess air will be discharged through bleeder hole 22. If the tubing 15 gets full, line 19 will be shut off, allowing the spring 27 to move the piston to the right, so that the lever 25 will move from the position shown in solid lines to that shown in dash lines, stopping the automatic screw machine. The tubing 15 is now filled so that the operator can replace the tubing with an empty tube for the reception of more parts or remedy a stoppage in a subsequent machine if the parts are going directly to another work station.

The heart of the machine consists of a spiral member generally designated 27 which consists of a helix 29 of metal with a hollow, circular center opening 31 through which parts 33 can pass with a small clearance. Member 27 is divided into four segments, namely 35, 37, 39 and 41. These segments can be formed individually or as a unit. The last three of these segments are surrounded by a tight-fitting casing 43 and these segments are separated from each other by O rings 44 to prevent the passage of liquids or gases from one section to the next. The section 35 extends beyond casing 43 and is connected to the output of the automatic screw machine 11. The O rings 44 divide the space within the casing 43 into three chambers designated 45, 47 and 49. Line 51 enters chamber 49 and leads to a source of compressed air, not shown, suitably at a pressure of 40 psi. Line 53 takes air from chamber 49 and injects it into the chamber 45 and an outlet for air is provided by line 54. Line 55 leads to a source of solvent, not illustrated, suitably under a pressure of 20 psi. An outlet 57 for the spent solvent is provided from chamber 47. It will be noted that in each of chambers 45, 47 and 49, the flow of fluid is countercurrent to the flow of parts 33.

Figure 5:
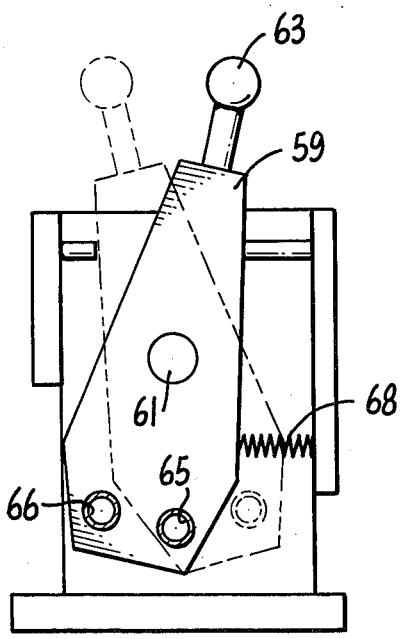
FIG. 5 is an end view of the novel valve arrangement employed in the present invention.

At the outlet end of the cleaning device a valve is provided which consists of a plate 59 pivoted at 61 and provided with a handle 63. Plate 59 has two holes which are the same size as the passage 31, namely a first hole 65 and a second hole 66 which can selectively be brought into alignment with passage 31. Spring 68 normally holds plate 59 in the position shown in solid lines in FIG. 5, and in this position hole 65 is in alignment with passage 31 and this hole is connected to an outlet 70 tube which is connected to the discharge tube 13. Hole 66 leads to a sample catcher 72.

The operation of the device will now be described. The parts 33 leave the automatic screw machine 11 in an oily or greasy condition. These particular parts are tumbler pins for locks, but it is obvious that the device could be used to clean any parts which would pass freely through the passage 31. As the parts pass through that portion of the helix 27 which has been designated 35, they are subjected to a scraping action by the convolutions of the helix, and a large portion of the oil will be scraped off of the parts. As the parts now enter the section 45, they are subjected to an air blast which contains a substantial amount of solvent vapor, as will be later apparent, introduced through line 53. This further removes oil from the parts. The parts now enter the chamber 47 where they are subjected to the solvent introduced through line 55 which washes the remaining oil or grease from the parts. The parts are now clean of oil but they still have adherent solvent as they enter the chamber 49 whereupon they are subjected to air from line 51 which evaporates the solvent from the parts, leaving the parts in a clean condition as they exit from the machine. As the air from line 51 passes through the chamber 49, it picks up a substantial amount of solvent vapor so that the air discharged through line 53 contains a substantial amount of solvent and aids in the cleaning operation as previously described.

As the parts leave the machine, they pass through the valve plate 59, into the connective pipe 70 and into the discharge tube 13 whereupon they pass into the flexible tubing 15 which is rolled on drum 16. Instead of storing the parts in a tube, they can naturally be passed directly to another machine for a subsequent operation such as tumbling, assembly or the like. When the tube 15 becomes filled or, should a jam occur on a subsequent machine, one of the parts will clog the exit Tee 17 and shut off the screw machine as previously described.

From time to time, it is ordinarily necessary to inspect a part to insure proper operation of the automatic screw machine. In such cases it is only necessary to momentarily move the lever 63 from the position shown in solid lines to the position shown in dot-dash lines, whereupon a sample will be injected from the machine into the sample tube 17 for inspection.

Although a specific embodiment of the machine has been described, it will be obvious to those skilled in the art that many variations can be made without departing from the spirit of this invention.

I claim:

1. A cleaner for cylindrical parts contaminated with oil or the like, said cleaner being adapted to be attached to a machine which ejects parts therefrom, comprising in combination:

a. a helix having a hollow, circular center opening through which said cylindrical parts can pass with a small clearance, said circular center opening being attached to the discharge of said machine whereby parts discharged from said machine will be pushed into said circular center opening, said helix being divided into four sections arranged in the following order;

b. a first section of said helix open to the air whereby parts passing through said circular center opening with small clearance have a substantial amount of oil scraped from said parts while going through said opening;

c. a second section of said helix, said second section being enclosed and having sealing means at each end thereof whereby only the circular center opening in said helix provides an opening at the ends of said section;

d. means for introducing an air-solvent mixture at one end of said second section and means for removing the air-solvent mixture from the opposite end of said section;

e. a third section of said helix having an enclosure therearound with sealing means at each end thereof whereby said circular center opening provides the only opening at the ends of said enclosure and means for introducing a solvent into said third section near one end of said enclosure and for removing the solvent at the opposite end of said fourth enclosure;

f. a fourth section of said helix having an enclosure therearound with sealing means at each end of said section wherein said central opening provides the only opening at the ends of said fourth section and means for introducing an air blast into said section near one end thereof to remove adhering solvent from said parts and for removing air and solvent from said fourth section at the opposite end of said fourth section enclosure; and g. an exit end of said circular opening whereby parts are discharged from the circular opening.

2. The cleaner of claim 1 wherein said air and solvent remained from said fourth section is introduced into said air-solvent introducing means of said second section.

3. The cleaner of claim 1 having a valve means at the end thereof, said valve means having a swinging connection wherein a first tube and a second tube can be selectively placed over the discharge end of said central section, said first tube being connected to a transport tube from said machine and said second tube including a sample catcher.

4. The cleaner of claim 4 having a tube attached to the discharge end of said circular center opening, said tube having a T connection therein with the side arm of said T leading to a shut off device on said machine, said shut off device including a piston having an arm thereon attached to a control lever on said machine, said piston including a bleeder opening and a spring normally biasing said machine to an off position, said passage from said arm of said T leading to said cylinder opposite said spring whereby pressure in said cylinder from said line normally biases said piston against said spring and wherein a clogging of said line will reduce the pressure in said line allowing said spring acting on said piston to shut off said machine.

* * * * *